United States Patent [19]

Walker

[11] 3,975,866

[45] Aug. 24, 1976

[54] METHOD AND APPARATUS FOR MACHINING HOUSINGS FOR SLANT AXIS ROTARY MECHANISMS

[75] Inventor: Donald F. Walker, Leamington, England

[73] Assignee: Caterpillar Tractor Co., Peoria, Ill.

[22] Filed: Nov. 24, 1975

[21] Appl. No.: 634,814

[52] U.S. Cl. ..... 51/281 R; 51/50 R; 51/97 R; 51/105 R; 90/20

[51] Int. Cl.[2] ..... B24B 5/16

[58] Field of Search ..... 90/20; 51/97 NC, 97 R, 51/105 R, 90, 281 R, 50 R

[56] References Cited

UNITED STATES PATENTS

| | | | |
|---|---|---|---|
| 928,164 | 7/1909 | Taylor | 51/97 R |
| 3,867,868 | 2/1975 | Natkai et al. | 90/20 |

*Primary Examiner*—Harold D. Whitehead
*Assistant Examiner*—K. J. Ramsey
*Attorney, Agent, or Firm*—Wegner, Stellman, McCord, Wiles & Wood

[57] ABSTRACT

Method and apparatus for machining an end surface for a housing for a slant axis rotary mechanism having a slant angle of  and a rotor to shaft to housing timing ratio of $S_R/S_S S_H$. The method includes the steps of providing a grinding tool within a fixed predetermined area, rotating a housing having an end surface to be machined about its central axis at a first rate of rotation $R_1$ with the end surface engaged by the tool, and simultaneously rotating the housing about a second axis intersecting the central axis at an angle  and at a second rate of rotation $R_2$. The rates of rotation are chosen according to the following relations: $R_1 = n(S_H - S_R)$, and $R_2 = n(S_S - S_R)$. $n$ Is an arbitrarily selected average angular velocity component. The disclosed apparatus performs the above method.

8 Claims, 4 Drawing Figures

Fig. 3.
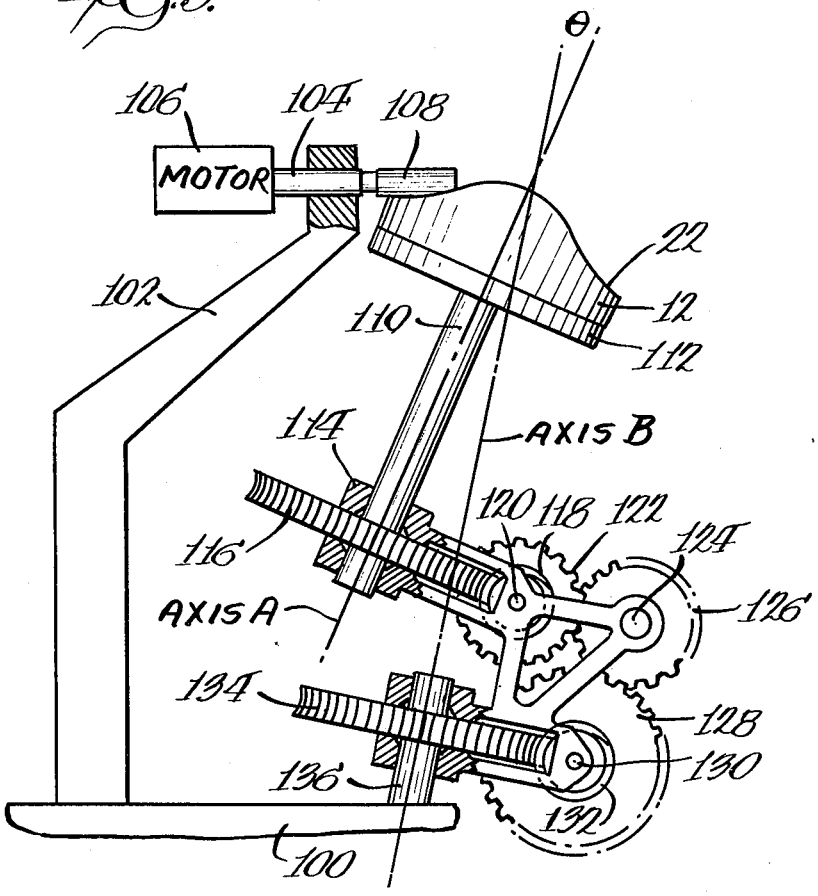
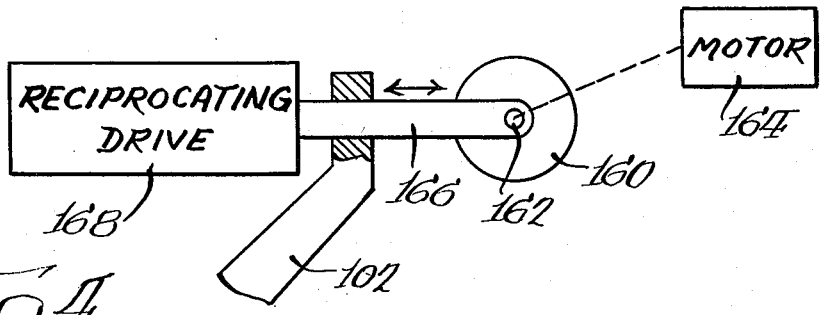
Fig. 4.

METHOD AND APPARATUS FOR MACHINING HOUSINGS FOR SLANT AXIS ROTARY MECHANISMS

BACKGROUND OF THE INVENTION

This invention relates to method and apparatus for machining the end surface for the housing of a slant axis rotary mechanism, such as an engine, pump, compressor or the like.

Considerable difficulty is experienced in machining the end surfaces of the housings of slant axis rotary mechanisms. The degree of difficulty depends, to some extent, on whether the mechanism is a two-cycle mechanism, a four-cycle mechanism, etc.

In a four-cycle mechanism, in a developed view, the end housings will appear to be sinusoidal. Generally, they will be somewhat conical as well. Consequently, an extremely difficult task is present in machining the requisite contour.

The task is made more difficult by other practical factors concerned with operation of the mechanism. Most, if not all, such mechanisms include seals carried by a rotor, which seals traverse the end surfaces. Experience has shown that if marks remaining from machining of the surface extend generally transversely to the mean seal length, premature seal failure will occur. Conversely, when such machining marks extend generally parallel to mean seal length, the life of the seal is considerably prolonged.

In some instances, where high pressures are encountered during operation of the mechanism, particularly when used as an engine, it is desirable that the end surfaces be convex or concave to more rigidly withstand the pressures. Such rigidity minimizes deflection of the housing in response to high pressures and as a consequence, allows the use of lesser clearances between the rotor and the housing walls, thereby minimizing parasitic volume of the mechanism and increasing its efficiency. Of course, when such configurations are employed, the already difficult task of machining an undulating and conical surface as in a four-cycle slant axis rotary mechanism is considerably increased.

SUMMARY OF THE INVENTION

It is the principal object of the invention to provide a new and improved method and apparatus for machining the end surfaces of housings employed in slant axis rotary mechanisms. More specifically, it is an object of the invention to provide such a method and apparatus wherein the end surfaces of the housings may be reliably machined to the desired configuration, and wherein other practical considerations such as the direction of machine marks in concave or convex configurations can be easily controlled.

An exemplary embodiment of a method according to the invention is applicable to slant axis rotary mechanisms regardless of the number of cycles employed. As is always the case, the mechanism will have a given slant angle of $\theta$ chosen by conventional design standards, and a rotor-to-shaft-to-housing timing ratio of $S_R/S_S/S_H$, determined by the number of cycles employed in the mechanism.

The steps of the inventive method including the provision of a grinding tool within a fixed, predetermined area; rotating a housing having an end surface to be machined about its central axis at a first rate of rotation $R_1$, with the end surface engaged by the tool; and simultaneously rotating the housing about a second axis intersecting the central axis at the angle $\theta$ and at a second rate of rotation $R_2$. The rates of rotation are chosen according to the following relations:

$$R_1 = n(S_H - S_R) \text{ and}$$
$$R_2 = n(S_S - S_R)$$

where $n$ is an arbitrarily selected average angular velocity component.

Where it is necessary that machine marks extend generally parallel to mean seal length, the tool employed in the preceding method is reciprocated in the fixed area across from the end surface. Where the direction of extension of machine marks is not of particular concern, the tool may be rotated about a fixed axis.

Where the method is employed in the fabrication of housings for four-cycle slant axis rotary mechanisms, the ratio $S_R/S_S/S_H$ is proportional to 1/3/0. $R_1$ is chosen to equal $-n$ and $R_2$ is chosen to equal $2n$.

An exemplary embodiment of an apparatus for performing the inventive method includes a grinding tool and a means supporting the tool in a predetermined area. Means are provided for supporting a housing having an end surface to be machined with a portion of the end surface in the area to be engaged by the tool. Means are provided for rotating the supporting means at a first rate of rotation equal to $R_1$ as mentioned above and about a first axis such that the end surface is rotated about its central axis. Means are also provided for simultaneously rotating the supporting means about a second axis intersecting the first axis at the slant angle $\theta$ and at the above-mentioned rate of rotation $R_2$. Means are also provided for establishing a relation between the rates of rotation according to those set forth above.

The apparatus also contemplates the provision of means for reciprocating the tool towards and away from the first axis to provide for desired orientation of machine marks.

Other objects and advantages of the invention will become apparent from the following specification taken in connection with the accompanying drawings.

DESCRIPTION OF THE DRAWINGS

FIG. 3 is a view similar to FIG. 2 showing the apparatus in a different position during its operation; and FIG. 4 is a somewhat schematic, fragmentary view of a modified embodiment of the invention.

DESCRIPTION OF THE PREFERRED EMBODIMENTS

Figure 1:
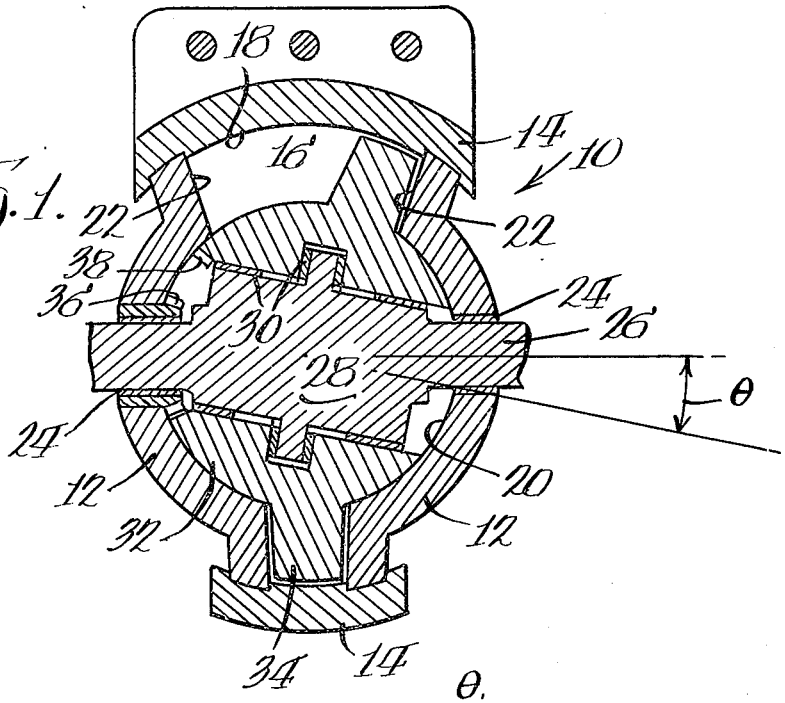
FIG. 1 is a sectional view of a slant axis rotary mechanism and is provided for illustrative purposes.

Prior to describing in detail the inventive method and apparatus of the present invention, reference is made to FIG. 1, which illustrates a four-cycle, slant axis rotary mechanism, such as an engine, pump, compressor or the like. The mechanism includes a housing, generally designated 10, including end members 12 and half-shell-like circumferential members 14. The members 12 and 14 define a chamber 16, a portion of which acts as an operating cavity as is well known. The chamber 16 is bounded by a radially outer spherical surface 18, defined by the members 14, a radially inner spherical surface 20 and interconnecting end surfaces 22. The surfaces 20 and 22 are formed in the end members 12.

The end members 12, by means of suitable bearings 24, journal the main shaft 26 of the mechanism. The shaft 26 has an angularly offset portion 28 disposed within the chamber 16. The offset angle is illustrated as the angle $\theta$ in FIG. 1.

By means of suitable thrust and journal bearings 30, a rotor 32 is journalled on the angularly offset portion 28 and within the chamber 16. The rotor 34 has a radially outwardly extending peripheral flange 34 and carries a variety of sealing elements (not shown) all of which are conventional.

The basic system is completed by a timing gear 36 which meshes with an internal ring gear 38 formed at one end of the rotor 34 to establish the proper time relation between the rotor 34 and the shaft 26. In a four-cycle mechanism, the shaft 26 will undergo three revolutions for every revolution of the rotor 34. Normally, but not always, the housing 10 will be maintained stationary.

In a two-cycle mechanism, the shaft will rotate twice for each revolution of the rotor. For mechanisms having other numbers of cycles, the relative rates to achieve operation are well within the skill of the art.

The present invention is concerned with machining the end surfaces 22 on the end members 12. The spherical surfaces 20 on the end members 12 as well as those of 18 on the half-shell members 14 are easily machined according to well-known techniques.

The method of machining the end surfaces, in its basic sense, includes the steps of providing a grinding tool at a fixed predetermined area. The tool will typically be a rotary grinding tool and may be fixed in the area against all movement other than rotation about the axis about which it is driven. Alternately, it may be reciprocated in the area while being driven, and along a predetermined path.

The housing having an end surface to be machined is rotated about its central axis at a first rate of rotation $R_1$ with the end surface engaged by the tool.

Simultaneously, the housing is rotated about a second axis intersecting the central axis at an angle $\theta$ (equal to the desired slant angle of the mechanism to be formed) and at a second rate of rotation $R_2$.

The rates of rotation are chosen according to the following relationships:

$R_1$ is equal to $n(S_H - S_R)$, and $R_2$ is equal to $n(s_S - S_R)$.

$S_H/S_R/S_S$ represent the corresponding factors in the rotor-to-shaft-to-housing timing ratio of the mechanism. $n$ is an arbitrarily selected average angular velocity component. In terms of being arbitrarily selected, $n$ will depend upon the consideration of various factors including machining speeds, tool life, etc. The angular velocity component represented by $n$ is an "average" angular velocity component in terms of the fact that the invention contemplates both continuous rotation and step-wise intermittent rotation, and in some instances combinations thereof and rotations of varying rates. For example, where the grinding tool is not reciprocated, continuous rotation at a uniform rate may be employed. Conversely, in those instances where the tool is reciprocated in its area, intermittent rotary motion may be advantageously employed.

For a stationary housing, four-cycle rotary mechanism, such as illustrated in FIG. 1, the ratio $S_R/S_S/S_H$ will be proportional to the ratio of 1/3/0. Thus, the first rate of rotation $R_1$, will be equal to $-n$ while the second rate of rotation $R_2$ will be equal to $2n$. Thus, according to the method, the housing will be rotated about its central axis in one direction while being rotated about the second axis in the opposite direction at twice the rate.

Figure 2:
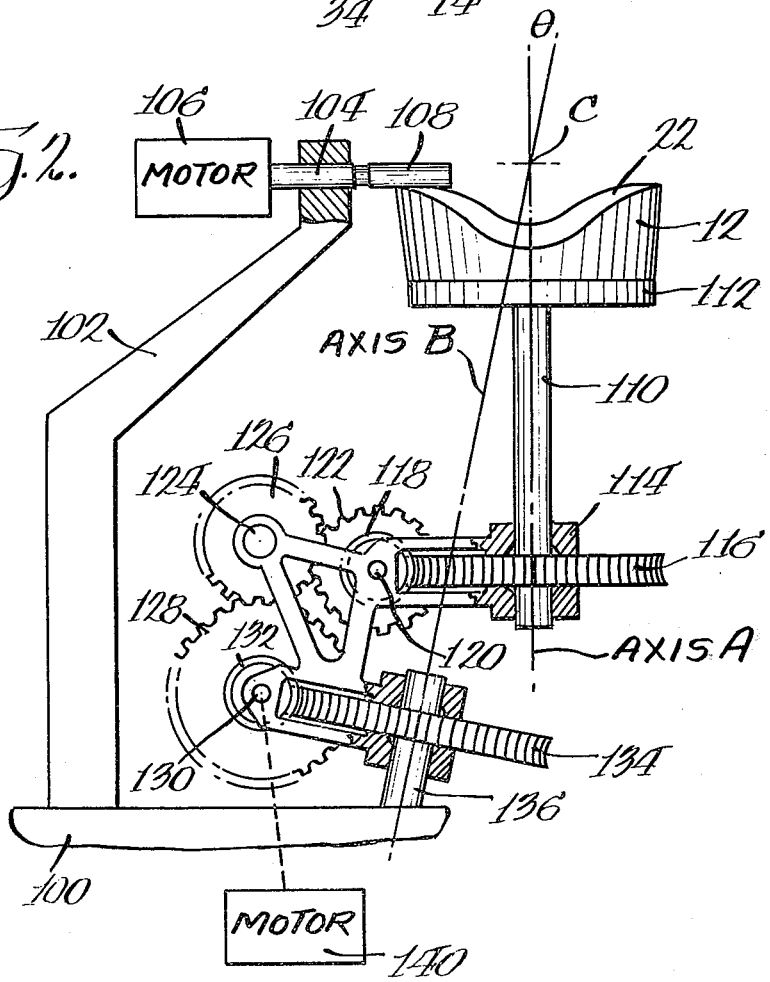
FIG. 2 is a side elevation of an apparatus for machining the end surface on housings of slant axis rotary mechanism in one position of operation and with parts broken away for clarity.

One form of an apparatus for performing the method is illustrated in FIGS. 2 and 3. The apparatus illustrated in FIGS. 2 and 3 is particularly designed for use in the fabrication of four-cycle mechanisms. However, it is to be understood that the same can be employed in the formation of mechanisms having differing numbers of cycles simply by changing the gear ratios to provide the relative rates of rotation determined by the above equations.

The apparatus includes a fixed support 100 mounting an upstanding pedestal 102. At the upper end of the pedestal 102 a shaft 104 is journalled The shaft 104 is rotated by a motor 106 and mounts a grinding spindle 108. Consequently, through operation of the motor 106, the spindle 108 will be rotated about the axis of the shaft 104 within a fixed area.

A shaft 110 is located in proximity to the area occupied by the grinding tool 108 and at its upper end mounts a work holder 112 for supporting an end housing member 12 such that the end surface 22 thereof will be engaged by the tool 108 to be machined thereby. The shaft 110 is journalled in a carriage 114 for rotation about its longitudinal axis such that the end housing member 12 will be rotated about its central axis, designated A in the drawing.

The lower end of the shaft 110 mounts a worm gear 116 which is meshed with a worm 118 carried by a shaft 120 also journalled on the carriage 114. The worm 118 is affixed to a timing gear 122, also carried by the shaft 120 for rotation therewith.

A shaft 124 mounts an idler gear 126 in engagement with the gear 122 as well as a timing gear 128 carried by a shaft 130 which is also journalled in the carriage 114.

The shaft 130 also carries a worm 132 which is secured to the timing gear 128 for rotation therewith. The worms 116 and 132 are disposed on the same side of gears 122 and 128. The worm 132 is in engagement with a worm gear 134 which is stationarily mounted on a stationary shaft 136 secured to the support 100. The shaft 136, by means of suitable bearings, journals the carriage 114 for rotation about a second axis, Axis B, which intersects the first axis, Axis A, at a point C and at the slant angle $\theta$.

Finally, a motor, shown schematically at 140, is employed to drive the shaft 130, as schematically illustrated in FIG. 2.

In the case where the apparatus is employed to machine the end housing for a four-cycle mechanism, the gear ratio between the gears 128 and 122 will be three to two. If the apparatus is employed for the manufacture of two-cycle mechanisms, the ratio will be two to one. For either ratio, the worm gears 116 and 134 should be provided with an equal number of teeth. In any event, upon energization of the motor 140, the gears 122 and 128 will be driven in the same direction, with the gear 122 being driven at a higher rate.

For purposes of demonstrating the operation of the apparatus in performing the inventive method, let us assume that the same is to be employed in the machining of an end surface for a four-cycle slant axis rotary mechanism. Thus, the gear ratio between the gears 128 and 122 will be three to two. It will also be recalled from the foregoing description of the inventive method that, for a four-cycle mechanism, the housing 12 should be rotated about its central axis, Axis A, in one direction at a particular rate of rotation and rotated about the second axis, Axis B, in the opposite direction at twice the rate of rotation. Assuming energization of the motor 140 causes the shaft 130 to be driven in a clockwise direction, the engagement of the worm 132 with the fixed worm gear 134 will cause the carriage 114 to be driven into the paper as illustrated in FIG. 2 about Axis B at a given rate of rotation. At the same time, by reason of the interposition of the idler gear 126 between the gears 128 and 122 and the above-mentioned three-to-two gear ratio, engagement of the worm 118 with the worm 160 will cause rotation of the shaft 110 to rotate the housing 12 about Axis A. Because the gear 122 is rotating at a rate 50% greater than the rate of rotation of the gear 128, this will cause the shaft 110 to be rotated in the opposite direction from the rotation of the carriage 114 at a rate equal to 50% of the rate rotation of the carriage 114 about Axis B.

In other words, shaft 110 is rotated about Axis A in one direction at one rate while the carriage 114 is rotated about Axis B in the opposite direction at twice the rate. Since the work holder 112 is carried by both the shaft 110 and the carriage 114 by reason of the shaft 110 being journalled in the carriage 114, the end member 12 is accordingly rotated about the two axes at the relative rates of rotation specified and, as can be seen from a comparison of FIGS. 2 and 3, the desired sinusoidal and somewhat conical surface will accordingly be generated.

FIG. 4 illustrates an alternate embodiment wherein the grinding tool 160 is mounted for rotation with a shaft 162 driven by a motor indicated schematically at 164. The assemblage is mounted on the end of the rod 166 which is slidably received in the pedestal 102 and connected to a reciprocating drive 168. Thus, through the use of the embodiment of FIG. 4, the grinding tool can be reciprocated towards and away from the central axis of the end housing 112. This will result in highly desirable radially oriented machine marks on the end surface of the housing 12 which promotes long seal life as mentioned previously.

In the event it is desired to provide a concave or convex configuration to the end surface, the same may be accomplished by either the embodiment of FIGS. 2 and 3 or the embodiment of FIG. 4. When the embodiment of FIGS. 2 and 3 is employed for the purpose, the shape of the grinding element 108 may be made like an hour-glass to provide a convex configuration or somewhat spherical to provide a concave configuration. When the embodiment of FIG. 5 is employed for the purpose, an appropriate cam-like guide may be employed to guide the grinding element 160 during its reciprocation in any path necessary to generate the desired configuration.

It is also to be noted that the locus of contact points of the grinding elements 108 and 160 on the end surface need not be that illustrated in FIGS. 2 and 3 with respect to either Axis A or Axis B. In general, such a locus of contact points will be on the order of about 90° to Axis A when the apparatus is in the configuration illustrated in FIG. 2. However, the actual angle selected will depend upon the desires of the designer of the mechanism and will generally be dictated by the desired orientation of the side of the rotor flange 34 with respect to the remainder of the rotor.

I claim:

1. A method of machining an end surface for a housing for a slant axis rotary mechanism having a slant angle of $\theta$ and a rotor-to-shaft-to-housing timing ratio of $S_R/S_S/S_H$ comprising the steps of:

providing a grinding tool at a fixed predetermined area, rotating a housing having an end surface to be machined about its central axis at a first rate of rotation $R_1$ with the end surface engaged by said tool, and simultaneously rotating the housing about a second axis intersecting said central axis at an angle $\theta$ at a second rate of rotation $R_2$, said rates of rotation being chosen according to the following relations:

$R_1 = n(S_H - S_R)$, and $R_2 = n(S_S - S_R)$, where $n$ is an arbitrarily selected average angular velocity component.

2. The method of claim 1 wherein said tool is reciprocated in said fixed area toward and away from the center of said end surface.

3. The method claim 1 wherein said tool is rotated about a fixed axis.

4. The method of claim 1 particularly suited for the machining of an end surface of a four-cycle, stationary housing slant axis rotary mechanism wherein $S_R/S_S/S_H$ is proportional to 1/3/0 and wherein:

$R_1 = -n$, and $R_2 = 2n$.

5. Apparatus for machining an end surface for a housing for a slant axis rotary mechanism having a slant angle of $\theta$ and a rotor to shaft to housing timing ratio of $S_R/S_S/S_H$, comprising:

a grinding tool;

means supporting said tool in a predetermined area;

means for supporting a housing having an end surface to be machined with a portion of said end surface in said area to be engaged by said tool;

means for rotating said supporting means at a first rate of rotation $R_1$ about a first axis such that such end surface is rotated about its central axis;

means for simultaneously rotating said supporting means about a second axis intersecting said first axis at an angle $\theta$ at a rate of rotation $R_2$; and means establishing a relation between said rates of rotation $R_1$ and $R_2$ as follows:

$R_1 = n\ (S_H - S_R)$ and $R_2 = n\ (S_S - S_R)$, where $n$ is an arbitrarily selected average angular velocity component.

6. The apparatus of claim 5 further including means for reciprocating said tool toward and away from said first axis.

7. The apparatus of claim 5 wherein said tool is constructed and arranged to generate substantially only radially extending machine marks on said end surface.

8. Apparatus for machining the end surface of a housing for a slant axis rotary mechanism; comprising:

a stationary support;

a grinding tool mounted on said support for operation in a predetermined area adjacent said support;

a carriage;

means mounting said carriage for rotation about a first axis and in proximity to said area;

a work holder rotatably mounted on said carriage for rotation about a second axis intersecting said first axis at a predetermined angle, said work holder being adapted to hold a housing for a slant axis rotary mechanism within said area such that a surface thereof may be engaged by said tool; and means for simultaneously rotating said carriage and said work holder about said first and second axes, respectively, at different, predetermined rates.

* * * * *